US010767434B2

(12) United States Patent
Andueza

(10) Patent No.: US 10,767,434 B2
(45) Date of Patent: Sep. 8, 2020

(54) HYDRAULIC WELLHEAD CONNECTOR

(71) Applicant: FMC TECHNOLOGIES DO BRASIL LTDA, Rio de Janeiro (BR)

(72) Inventor: Alejandro Andueza, Rio de Janeiro (BR)

( * ) Notice: Subject to any disclaimer, the term of this patent is extended or adjusted under 35 U.S.C. 154(b) by 0 days.

(21) Appl. No.: 16/081,220

(22) PCT Filed: Mar. 2, 2016

(86) PCT No.: PCT/BR2016/050045
§ 371 (c)(1),
(2) Date: Aug. 30, 2018

(87) PCT Pub. No.: WO2017/147667
PCT Pub. Date: Sep. 8, 2017

(65) Prior Publication Data

US 2019/0085650 A1 Mar. 21, 2019

(51) Int. Cl.
*E21B 33/038* (2006.01)

(52) U.S. Cl.
CPC ..... *E21B 33/038* (2013.01)

(58) Field of Classification Search
CPC ..... E21B 33/038
See application file for complete search history.

(56) References Cited

U.S. PATENT DOCUMENTS 1,913,030 A * 6/1933 Hux ..... E21B 33/12 166/196
3,096,999 A 7/1963 Ahlstone et al.
3,851,897 A 12/1974 Piazza et al.
4,424,988 A * 1/1984 Cowx ..... E21B 17/085 285/18
4,496,172 A 1/1985 Walker
4,516,795 A 5/1985 Baugh
4,647,254 A * 3/1987 Baugh ..... F16L 37/002 405/169

(Continued)

FOREIGN PATENT DOCUMENTS

CA 1224410 A 7/1987
GB 2480571 A 11/2011

OTHER PUBLICATIONS

International Search Report issued in PCT/BR2016/050045 dated Nov. 9, 2016 (3 pages).

(Continued)

*Primary Examiner* — Matthew R Buck
(74) *Attorney, Agent, or Firm* — Osha Liang LLP

(57) ABSTRACT

A hydraulic connector type "Titus", applicable in oil production and extraction operations in the seabed, is able to provide connection between cylindrical bodies (WCT and a wellhead, for example). The locking system has a primary hydraulic circuit and the unlocking system has primary and secondary hydraulic circuits. However, the pre-load adjustment system is performed through the friction self-locking angle, being the parallel locking the mechanism determining to prevent the accidental unlocking of the connector, including when exposed to vibration. The connector has a set of jaws, one main actuator hydraulic piston, pressurization chambers, secondary piston, sealing elements, an external liner, a lower guide, a two-part top cover, attachment screws, a two-part ring, conical surface and hydraulic fluid lines.

13 Claims, 3 Drawing Sheets

(56) References Cited

U.S. PATENT DOCUMENTS

| | | | | |
|---|---|---|---|---|
| 4,902,044 | A * | 2/1990 | Williams | E21B 33/038 166/340 |
| 6,070,669 | A | 6/2000 | Radi et al. | |
| 6,966,382 | B2 * | 11/2005 | Buckle | E21B 33/038 166/348 |
| 7,614,453 | B2 * | 11/2009 | Spiering | E21B 33/038 166/338 |
| 8,474,537 | B2 * | 7/2013 | Voss | E21B 33/038 166/338 |
| 9,169,710 | B2 * | 10/2015 | Jahnke | E21B 33/038 |
| 9,650,855 | B2 * | 5/2017 | Caldwell | E21B 33/038 |
| 2003/0151254 | A1 | 8/2003 | Baugh | |
| 2004/0102069 | A1 * | 5/2004 | Singeetham | E21B 33/038 439/157 |
| 2005/0001427 | A1 | 1/2005 | Liew | |
| 2005/0034870 | A1 | 2/2005 | Buckle et al. | |

OTHER PUBLICATIONS

Written Opinion of the International Searching Authority issued in PCT/BR2016/050045 dated Nov. 9, 2016 (7 pages).
International Preliminary Report on Patentability from PCT/BR2016/050045 dated Jun. 4, 2018 (17 pages).

* cited by examiner

HYDRAULIC WELLHEAD CONNECTOR

FIELD OF THE INVENTION

The present invention refers to a hydraulic connector for providing connection between the equipment installed in the land or marine surfaces, as well as between those installed in subsea environment. More specifically, the present invention refers to a hydraulic connector for providing connection between the equipment installed remotely in big depths in subsea applications for extracting oil. The hydraulic connector according to the present invention is type "Titus" that, among other applications, highlights WCT connection (Wet Christmas Tree) with the subsea wellhead, VCM connector (Vertical Connection Module) with PLET (Pipeline End Termination). The present invention also refers to a process performing the hydraulic connection using the said hydraulic connector.

BACKGROUND OF THE INVENTION

The subsea hydraulic connectors have the function of making a rigid connection between two equipment and performing the resulting sealing among them. The connector locking is performed by driving a hydraulic piston that, through the forces transmission mechanism, generates a pre-load of the connector design needed for suitable functioning.

Currently there are two basic concepts of connectors. The first concept of connector uses a parallel locking system where an interference through an assembly adjustment system is generated. This interference produces the pre-load defined in the connector design3 for a suitable functioning. This concept is applied in the connectors disclosed in the documents of the state of the art CA1224410, US2003/0151254 and US2005/0001427. The second concept of connector currently used has a friction self-locking system for performing the locking and the resulting rigid connection between two equipment. This connector type requires less components and it is much more dependent on the friction between the surfaces for applying the connector design pre-load. The state of the art documents U.S. Pat. Nos. 4,516,795, 6,070,669, 7,614,453 and 8,474,537 disclose this type of hydraulic connector.

As well known by the people skilled in the art, the wellhead connectors are designed for connecting a BOP (Blow Out Preventer) to the wellhead, directly or, indirectly via flow-line.

Typically, such connectors include an annular main body that is aligned and connected axially to the subsea wellhead. For conceiving the connection, the connector is commonly provided with a cam ring, moving radially due to a hydraulic actuator, normally a hydraulically-driven piston, forcing the cam ring and, consequently, the teething devices, for locking or unlocking purposes.

A configuration used for connecting in wellheads consisted of a clamp, generally in "C" shape, with single contact surface. Later, connections were designed with H4 profiles that are characterized for better distributing the stress compared to those used with single surface.

Between the examples of the state of the art, we may mention specifically the document U.S. Pat. No. 4,496,172 disclosing a connector comprising jaws driven by a cam ring moving in parallel with the locking ring, being linked to pistons rods in cylinders, by which an annular plate. The pistons driving are remotely and preferably performed by hydraulic fluid lines.

The document GB2480571 also illustrates a connector with multi-tooth profile scaling the load by the profile imposing better reliability in the connection and lower wear of the connector. The document U.S. Pat. No. 3,096,999 illustrates a connector with single contact surface profile.

Other examples of connectors may differ in size, shape, number of tooth, types of hydraulic actuators, locking systems etc.

The parallel locking connectors have, among others, a technical important inconvenient that is the extreme dependence of an increased number of components that allow the pressure adjustment needed for assembling the equipment, leading also to an important inconvenient of manufacturing and assembly costs. On the other hand, the friction self-locking connectors have extreme dependence between the pre-load and the friction coefficient between the surfaces of the several connector components. In addition, the friction self-locking connector shows a big sensitivity to manufacturing tolerances, making the connection susceptible to accidental unlocking, mainly in the presence of vibration, what binds the connector to include a security system aiming to avoid the said accidental unlocking for achieving higher reliability. This requirement of additional components and also for this type of connector generates a big technical inconvenient, which additionally causes a significant increase of the manufacturing, assembly costs and, consequently, the operation cost.

Therefore, it is the main object of the present invention provide a hydraulic connector, notedly for applying in wellhead in oil production and extraction operations, particularly in the seabed, solving advantageously the technical inconvenient and economic disadvantages indicated above.

BRIEF DESCRIPTION OF THE INVENTION

The hydraulic connector according to the present invention is type "Titus" and has parallel locking features, but without requiring additional components for adjusting the locking pressure.

For such, the hydraulic connector of the present invention has annular shape for wellhead applications in oil production and extraction operations in the seabed, comprising parallel locking features via primary locking lines and primary and secondary unlocking, thereby without requiring additional components for adjusting the locking pressure.

The use of these locking methodologies in the same hydraulic connector introduces in the oil sector a new concept of self-adjustment with friction self-locking angle, removing the traditional adjustment systems during the assembly procedure, besides ensuring the connector does not unlock by vibration.

BRIEF DESCRIPTION OF THE FIGURES

The hydraulic connector according to the present invention shall be understood with the figures description in attachment, such that not limiting, illustrates an example of its structure basic configuration. We have:

The FIG. 1—detailed view of the connector internal components (locked position).

Figure 2:
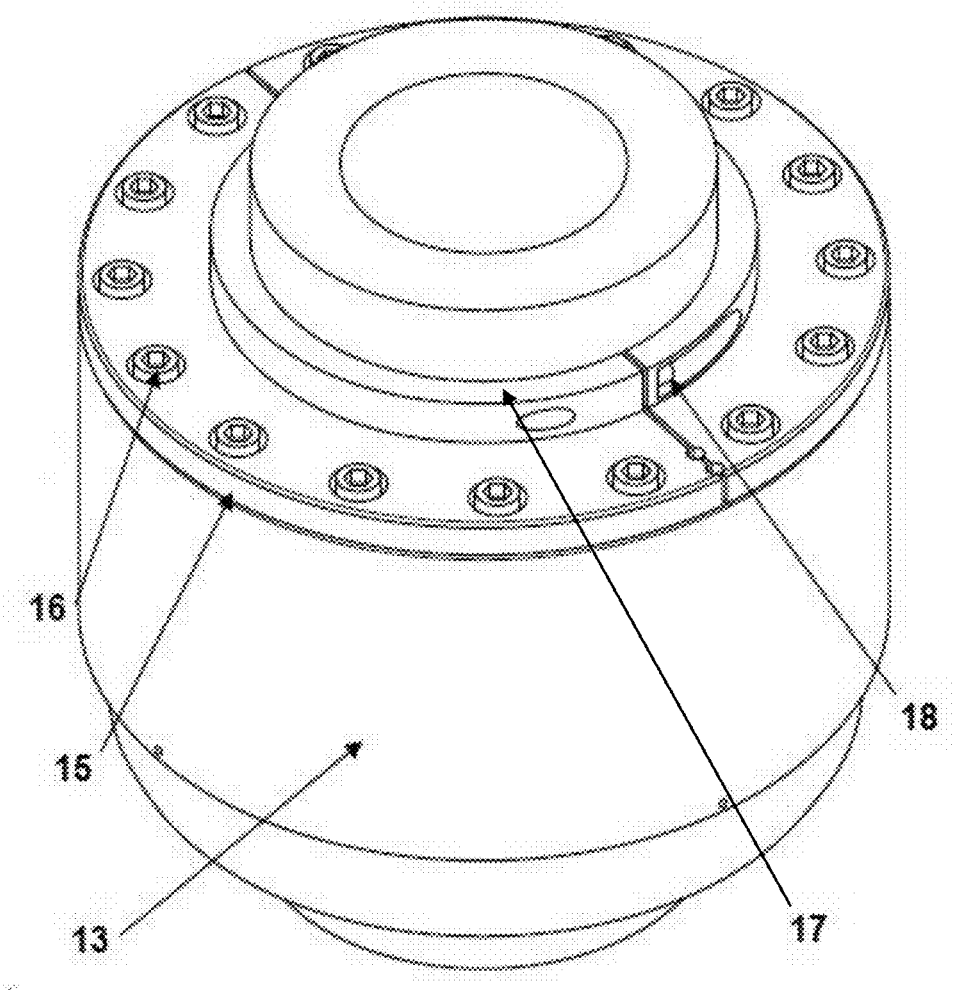

The FIG. 2—detailed view of the connector external components.

Figure 3:
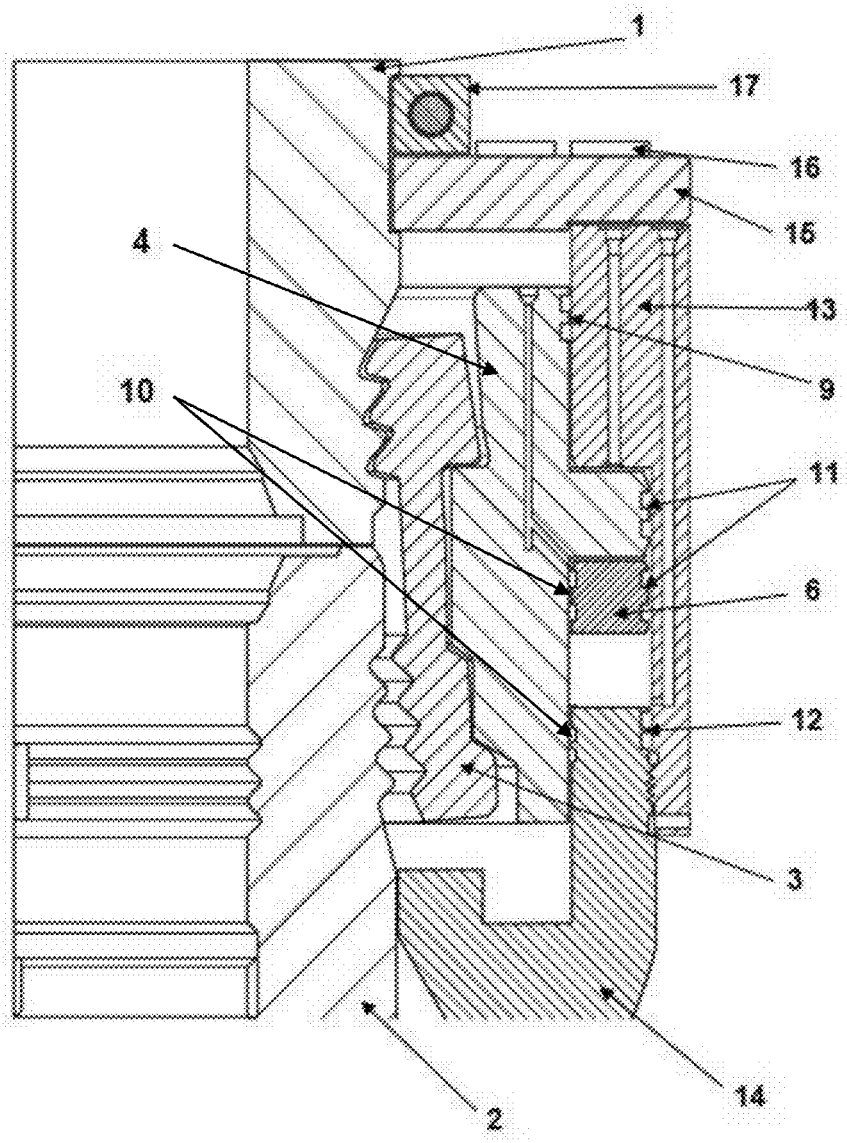

The FIG. 3—detail of the locking system components (unlocked position).

DETAILED DESCRIPTION OF THE INVENTION

Figure 1:
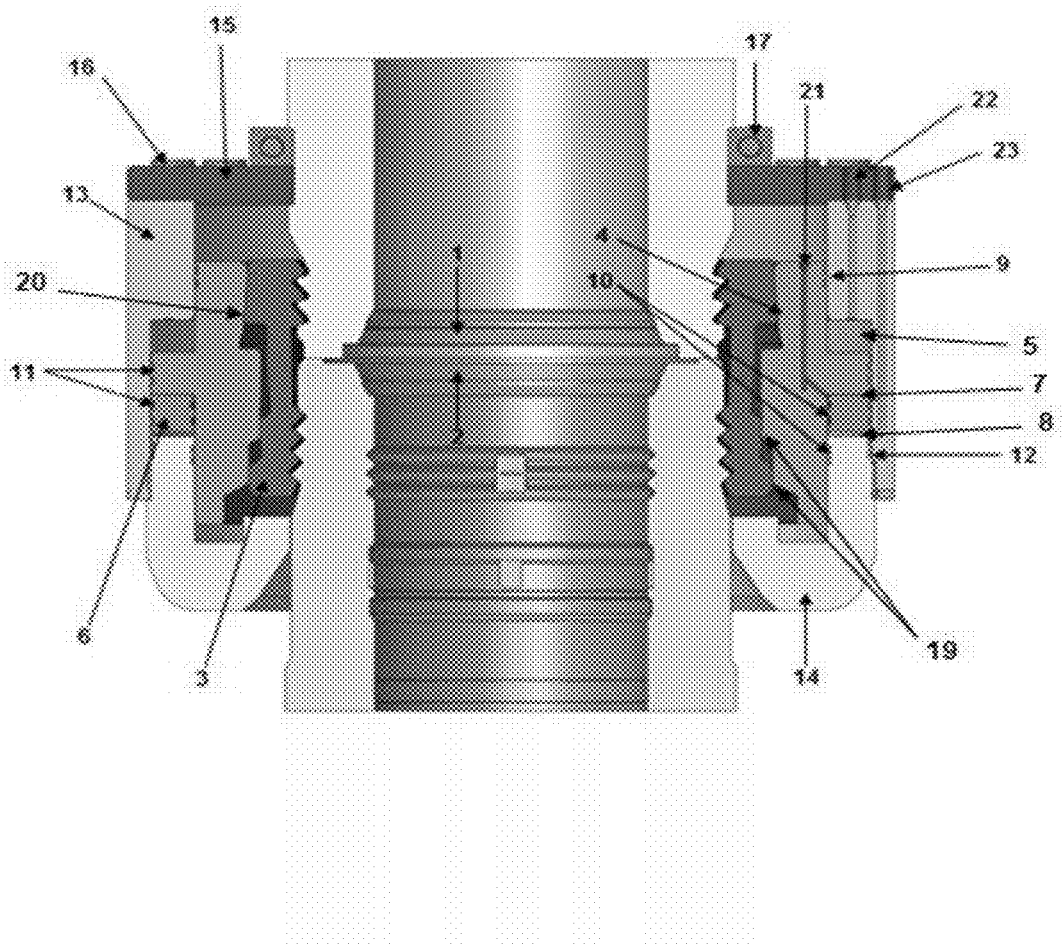

As can be seen in the FIGS. 1-3, the hydraulic connector according to the present invention allows the connection between two cylindrical bodies (1) and (2) and comprises jaws (3) positioned and pre-loaded by an actuator hydraulic piston (4) through the pressurization chamber (5). The hydraulic connector has redundancy in the unlocking through the secondary hydraulic piston (6). The pressurization chambers (5), (7) and (8) are established by the sealing elements (9, 10, 11, 12), by the main (4) and secondary (6) pistons, external liner (13) and lower guide (14). The hydraulic connector of the present invention also comprises a two-part top cover (15) attached to the external liner (13) by screws (16). The said two-part top cover (15) is equally attached to the top cylindrical body (1), but through a two-part ring (17) which both parts are attached among each other preferably by screws (18) positioned in the circumferential direction of the said two-part ring (17).

As is known from the state of the art, the components manufacturing tolerances, with possible variations of the friction coefficient between the surfaces, modify the specified pre-load nominal value for the equipment. Thus, such that to solve this unavoidable problem, the conical surface (20) between the jaws (3) and the main piston (4) of the hydraulic connector according to the present invention has as function to adjust the equipment final pre-load and provide friction self-locking features.

The process for performing the hydraulic connection according to the present invention comprises the hydraulic connector locking according to the present invention, with the specified pre-load application, through the locking hydraulic fluid lines (22) derived from any origin. This hydraulic fluid line (22) pressurizes the chamber (5) driving the locking main piston (4). The locking main piston (4), that has cylindrical faces (19), is then forced in vertical movement downwards causing the interference of the said cylindrical faces (19) with the internal diameters of the main piston (4) in the region, moving the jaws (3) in the radial direction such that to link between the cylindrical bodies (1) and (2) pre-loading surfaces in this way the connection. After locking the connector the hydraulic pressure is removed, being the equipment locked not needing to apply external forces.

The hydraulic connector unlocking is performed by the pressurization of the primary (7) or secondary (8) unlocking chambers using the hydraulic fluid lines (21) and (23), respectively. This procedure forces the secondary piston (6) to act over the main piston (4) providing its vertical movement upwards and removing the load over the jaws (3), making the jaws (3) to move radially outward, back to the unlocked position.

As appreciated by the people skilled in the art, the hydraulic connector according to the present invention, using the locking with the specified pre-load application, thus allow to dispense additional components for the adjustment system during the assembly procedure, besides ensuring the accidental non-unlocking with vibration.

The hydraulic connector of the present invention combines in one equipment the advantages of the parallel locking with the advantage of not requiring the adjustment during the equipment set assembly, further providing positive locking features with additional advantage of not requiring additional components to perform the equipment locking pressure adjustment. Several faces with parallel locking allow reducing the driving piston travel and its gap during the driving also allows the reduction of the force necessary for hydraulic connector locking.

Additionally, it is highlighted that the hydraulic connector object of the present invention was conceived, particularly, for using in subsea equipment for the hard connection of two equipment, such as wellhead, WCT, PLET, VCM, risers among many others.

The invention claimed is:

1. A hydraulic connector for connecting between two cylindrical bodies, comprising:

jaws positioned around the two cylindrical bodies and pre-loaded by an actuator hydraulic main piston through a pressurization chamber provided proximate an upper end of a radially outward surface of the actuator hydraulic main piston, wherein the actuator hydraulic main piston is positioned around the jaws, and wherein a set of cooperating conical surfaces are provided between the jaws and the actuator hydraulic main piston, wherein the set of cooperating conical surfaces comprises a radially outward conical surface of an upper end of the jaws positioned radially inwardly adjacent a radially inward conical surface of the actuator hydraulic main piston, and a set of cooperating cylindrical surfaces are provided between the jaws and the actuator hydraulic main piston, wherein the set of cooperating cylindrical surfaces comprises a radially outward cylindrical surface of a lower end of the jaws positioned radially inwardly adjacent a radially inward cylindrical surface of the actuator hydraulic main piston, and wherein the set of cooperating conical surfaces are in engaging contact in a locked position of the hydraulic connector and the set of cooperating cylindrical surfaces are in engaging contact in the locked position of the hydraulic connector;

a primary unlocking chamber provided proximate a lower end of the radially outward surface of the actuator hydraulic main piston;

a secondary hydraulic piston positioned around the actuator hydraulic main piston proximate the lower end of the radially outward surface and a secondary unlocking chamber provided proximate a lower end of the secondary hydraulic piston that provides redundancy in unlocking, the secondary hydraulic piston acting on an external face of the actuator hydraulic main piston;

an external liner disposed around the actuator hydraulic main piston and the secondary hydraulic piston; and a two-part top cover attached to the external liner and to a top cylindrical body of the two cylindrical bodies, through a two-part ring, wherein the two parts of the two-part ring are attached to each other by screws.

2. The hydraulic connector according to claim 1, wherein the pressurization chamber, the primary unlocking chamber, and the secondary unlocking chamber are formed by sealing elements disposed between the actuator hydraulic main piston and the secondary hydraulic piston surrounded, between the actuator hydraulic main piston and the external liner, between the actuator hydraulic main piston and a lower guide, and between the lower guide and the external liner, wherein the lower guide is positioned axially below the jaws, the actuator hydraulic main piston, and the secondary hydraulic piston.

3. The hydraulic connector according to claim 1, wherein the redundancy in the unlocking through the secondary hydraulic piston creates the primary unlocking chamber and the secondary unlocking chamber.

4. The hydraulic connector according to claim 1, wherein the two-part top cover is attached to the external liner through screws.

5. The hydraulic connector according to claim 1, wherein the screws are positioned in the circumferential direction for attaching both faces of the said two-part ring.

6. The hydraulic connector according to claim 1, further comprising a second set of cooperating cylindrical surfaces between the jaws and the actuator hydraulic main piston.

7. The hydraulic connector according to claim 1, wherein the external liner is equipped with hydraulic fluid lines, and the actuator hydraulic main piston has a hydraulic line within.

8. The hydraulic connector according to claim 1, wherein the set of cooperating conical surfaces provided between the jaws and the actuator hydraulic main piston provide a pre-load adjustment system through a self-locking friction angle.

9. The hydraulic connector according to claim 1, wherein a cooperating cylindrical surface of the actuator hydraulic main piston of the set of cooperating cylindrical surfaces provided between the jaws and the actuator hydraulic main piston comprises a first cylindrical surface having a first diameter and a second cylindrical surface having a second diameter different from the first diameter.

10. The hydraulic connector according to claim 1, wherein the hydraulic connector is used in subsea equipment for hard connection of wellhead, Wet Christmas Tree, Pipeline End Termination, Vertical Connection Module, risers and in installation tools of these equipment.

11. A process for performing a hydraulic connection comprising a hydraulic connector, according to claim 1, where the actuator hydraulic main piston moves downwards due to application of hydraulic pressure at a hydraulic fluid line, which pressurizes the pressurization chamber and produces the radial movement of the jaws, where the amount of pre-load is a function of the interference between the cylindrical bodies, the jaws, and the actuator hydraulic main piston and the applied hydraulic pressure.

12. The process for performing a hydraulic connection according to claim 11, wherein a step of unlocking the hydraulic connector comprises pressurization of the primary or secondary unlocking chambers by primary or secondary hydraulic fluid lines, respectively, to force the secondary hydraulic piston to act on the actuator hydraulic main piston causing vertical movement of the actuator hydraulic main piston upwards and removing the load over the jaws, thus leading the jaws to move radially outward, back to an unlocked position.

13. The process for performing the hydraulic connection according to claim 11, wherein the hydraulic pressure is removed at the end of the process of locking the hydraulic connection without unlocking the hydraulic connection.

* * * * *